US006035466A

United States Patent [19]

Homeyer

[11] Patent Number: 6,035,466

[45] Date of Patent: Mar. 14, 2000

[54] COLLAPSIBLE BABY BED

[76] Inventor: Shelley M. Homeyer, 2015 W. Main, Houston, Tex. 77098

[21] Appl. No.: 09/169,412

[22] Filed: Oct. 9, 1998

[51] Int. Cl.[7] ..... A47D 7/00; A47D 13/06

[52] U.S. Cl. ..... 5/99.1; 5/93.1; 5/98.1

[58] Field of Search ..... 5/99.1, 98.1, 93.1, 5/922, 923

[56] References Cited

U.S. PATENT DOCUMENTS

| | | | |
|---|---|---|---|
| D. 184,347 | 2/1959 | Gevertz | 5/98.1 X |
| 2,692,993 | 11/1954 | Baker | 5/98.1 |
| 2,710,976 | 6/1955 | Martensen | 5/98.1 |
| 2,784,420 | 3/1957 | Moltane | 5/98.1 |
| 3,018,493 | 1/1962 | Wittbrodt | 5/99.1 |
| 3,223,098 | 12/1965 | Dole, Jr. | 135/126 |
| 3,268,922 | 8/1966 | Moxley | 5/420 |
| 3,606,620 | 9/1971 | Glover | 5/98.1 X |
| 4,590,956 | 5/1986 | Griesenbeck | 135/116 |
| 4,811,437 | 3/1989 | Dillner et al. | 5/99.1 |
| 4,827,958 | 5/1989 | Cantwell et al. | 135/127 |
| 4,837,875 | 6/1989 | Shamie et al. | 5/99.1 |
| 4,852,598 | 8/1989 | Griesenbeck | 135/137 |
| 4,967,428 | 11/1990 | Browder | 5/922 X |
| 4,985,948 | 1/1991 | Mariol | 5/99.1 |
| 4,991,245 | 2/1991 | Franco | 5/419 |
| 5,197,154 | 3/1993 | Shamie | 5/99.1 |
| 5,243,718 | 9/1993 | Shamie | 5/99.1 |
| 5,287,571 | 2/1994 | Rademacher | 5/922 X |
| 5,361,794 | 11/1994 | Brady | 135/147 |
| 5,381,570 | 1/1995 | Cheng | 5/99.1 |
| 5,423,341 | 6/1995 | Brady | 135/139 |
| 5,435,024 | 7/1995 | Capshaw | 135/127 |
| 5,504,951 | 4/1996 | Yeh | 5/93.1 X |

*Primary Examiner*—Terry Lee Melius
*Assistant Examiner*—Robert G. Santos
*Attorney, Agent, or Firm*—Trop, Pruner, Hu & Miles, P.C.

[57] ABSTRACT

A collapsible baby bed includes a fabric cover which covers a collapsible tubular frame. The frame may include a plurality of links which are coupled by a resilient cord such that when in use, the bed may take a conventional crib or playpen shape and when the links are decoupled, the bed may be folded into a collapsed shape for storage or transport.

9 Claims, 5 Drawing Sheets

COLLAPSIBLE BABY BED

BACKGROUND

This invention relates generally to baby beds including devices which act as cribs, playpens or playards and the like.

Traveling with babies is often very difficult because a large amount of equipment is necessary to provide for the baby. While it is known to provide devices which may be collapsed for easier transport, many of these devices are still relatively difficult to store in a relatively small space. In addition, many of these devices are heavy, making it difficult to carry all the necessary items for supporting the baby.

For example, while collapsible playpens or playards are known, they generally include a relatively heavy frame connected by hinges. The frame may be collapsed with some effort, and it is still necessary to transport the relatively heavy device from place to place. For a mother traveling with a baby, this may mean that not only must the mother transport the baby, the baby's clothing and food, but the heavy bed must be moved as well.

Thus, there is a continuing need for a baby bed which may be readily transported from place to place, which may be easily set up at a new location, and which adequately protects the young child.

SUMMARY

In accordance with one embodiment, a collapsible baby bed includes a collapsible frame including at least two resiliently coupled links that may be selectively rigidly coupled to one another. A fabric cover is adapted to cover the frame.

DETAILED DESCRIPTION

Figure 1:
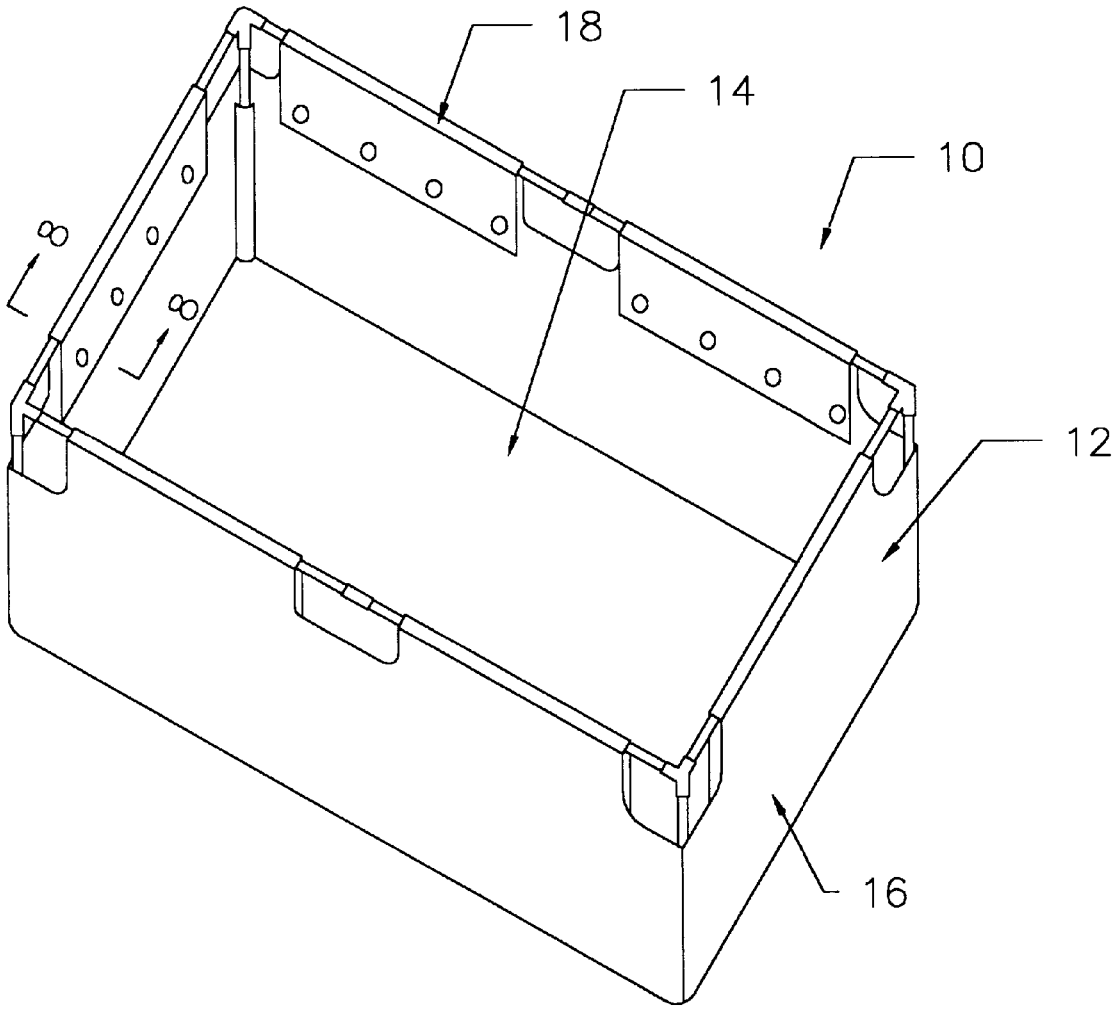
FIG. 1 is a perspective view of one of embodiment of the present invention.

Referring to the drawing wherein like reference characters are used for like parts throughout the several views, a baby bed 10, shown in FIG. 1, acts as a sleeping bed for a baby and as a playpen or playard when the baby is not sleeping. It includes a fabric cover 12 and a mattress 14 situated on the fabric cover 12. The fabric cover 12 includes, in the illustrated embodiment, four sides 16. The fabric cover 12 also includes flaps 18 which encircle a frame 20, shown in FIG. 2.

The frame 20 includes a plurality of links 26 connected by couplings 24 or 30. In the illustrated embodiment, the frame 20 includes four legs 28 formed by links 26 which connect with a rectangularly shaped portion 29 formed of links 26. Each of the links 26, coupled by a coupling 24 or 30, is of such a size that when the frame is collapsed, as shown in FIG. 4, the frame may take a relatively compact configuration.

The couplings 24 may be in-line couplings while the couplings 30 are used at the corners to connect three links 26 at right angles to one another. A foot 32 may be included at the bottom of each leg 28.

Figure 3:
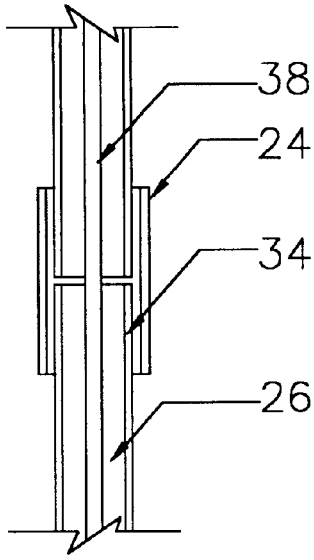
FIG. 3 is a cross-sectional view taken generally along line 3—3 in FIG. 2.

Referring to FIG. 3, each of the links 26 is connected by a coupling 24 or 30 as illustrated. The links 26 may be hollow tubes and the couplings 24 and 30 may likewise be hollow such that the links 26 telescope within the couplings 24 or 30, as illustrated in FIG. 3. In the illustrated embodiment, two adjacent links 26 abut at a joint 36 within a tubular coupling 24 or 30. Each link 26 may include a coupling 24 or 30 which is fixedly connected to one end of the link. The other end of each link may be removably telescoped within the interior of the coupling 24 or 30. Thus, the connection between adjacent links may be undone for storing the bed 10.

Figure 4A:
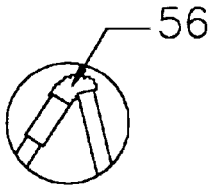
FIG. 4 is a front elevational view of the frame shown in FIG. 2 in its collapsed state.
Figure 4:
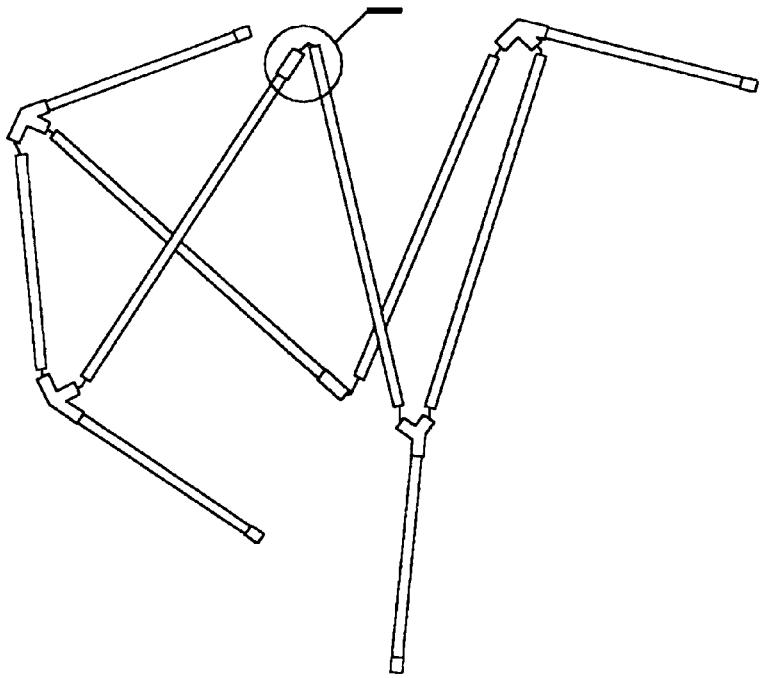

As shown in FIG. 4A, a tubular rubber boot 56 may be provided to cover the ends when the couplings are disconnected. This helps to prevent fingers from getting caught in the joint.

An elastic cord 38 extends through the interiors of all of the links 26 so that they are resiliently coupled to one another. When the frame is in the configuration shown in FIG. 2, the cord 38 is under tension, rigidly connecting all the links together to take the shape shown in FIG. 2. When the frame 20 is collapsed, as shown in FIG. 4, the cord 38 may no longer be in tension, and the frame 20 is no longer rigidly configured. In this configuration, the frame 20 may be folded and stored in a convenient fashion.

Figure 5:
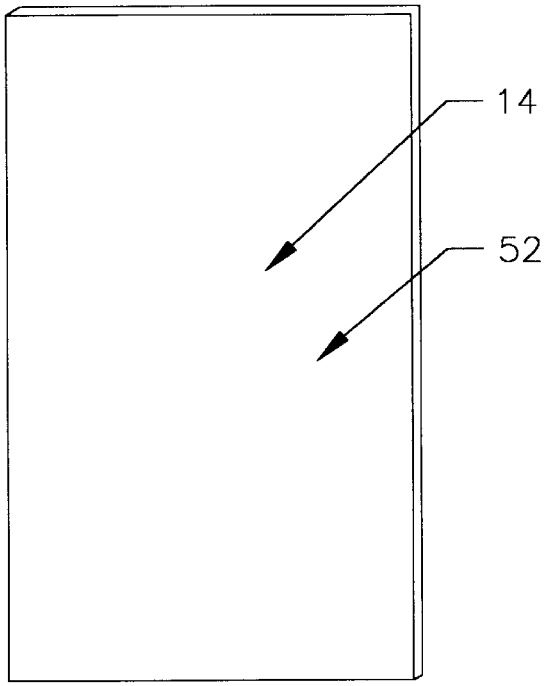
FIG. 5 is a perspective view of the mattress shown in FIG. 1.
Figure 6:
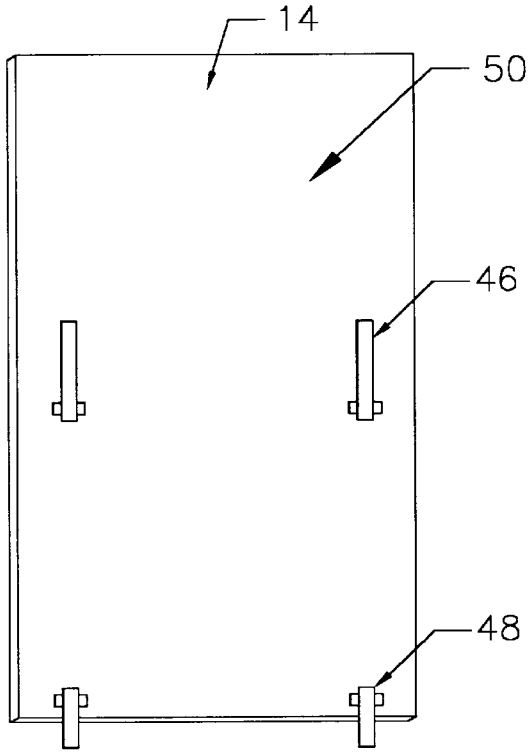
FIG. 6 is a perspective view of the mattress shown in FIG. 5 in a folded configuration.
Figure 7:
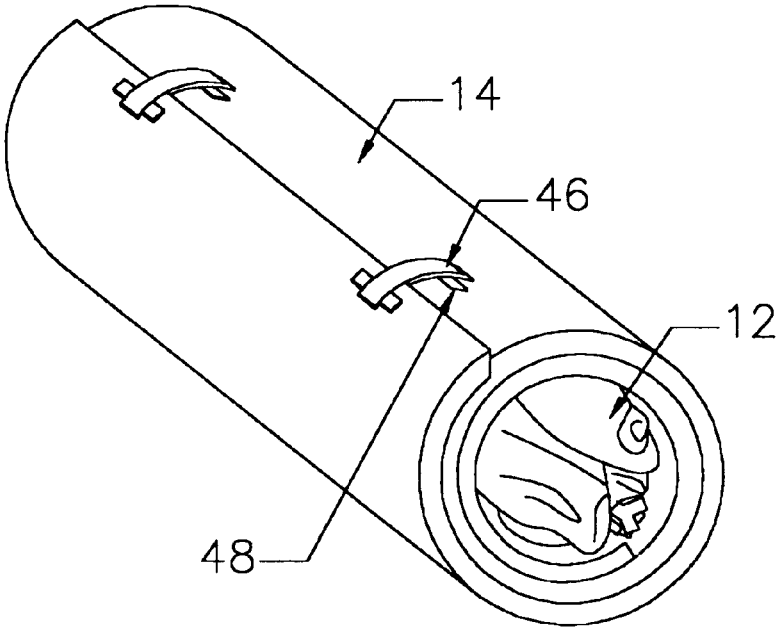
FIG. 7 is a perspective view of the baby bed as shown in FIG. 1 in a stowed condition.

Referring to FIG. 5, the mattress 14 may be formed of fabric enclosing a padding material. The side 50, opposite the side 52 (FIG. 5), may include a pair of catches 46 which mate with a pair of catches 48 on an end of the side 50 as shown in FIG. 6. In this way, the mattress 52 may be rolled up, as illustrated in FIG. 7, and the mattress ends may be connected to one another. In other words, the frame 20 may be folded up inside the cover 12, situated within the mattress 14, and the whole assembly may be connected together in a shape comparable to that of a sleeping bag.

Figure 8:
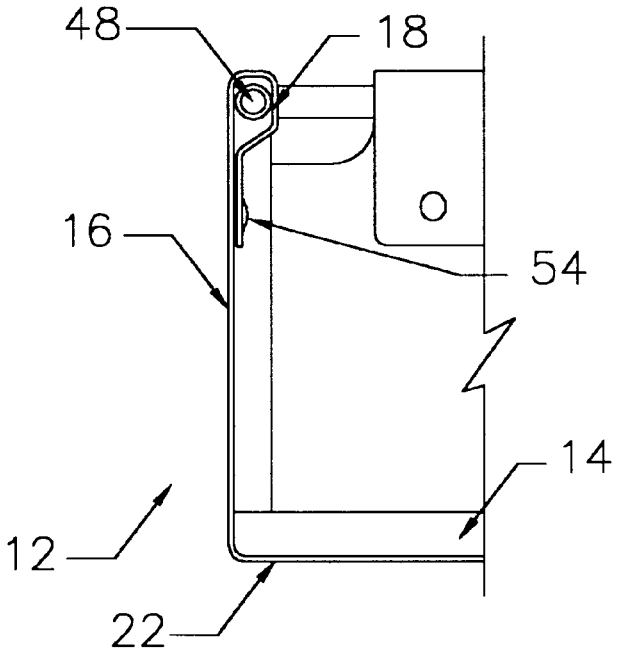
FIG. 8 is a cross-sectional view taken generally along the line 8—8 in FIG. 1.

Referring to FIG. 8, each of the flaps 18 of the cover 12 may fold over to be secured by buttons 54 or Velcro, as examples, to the inside surface of each side 16. Thus, if it is desired to wash the cover 12, the buttons 54 can be unattached, the frame 20 may be removed and the cover 12 may be washed. The cover 12 may have an open box shape with flaps 18 arranged to fold over each side 16. The box shaped cover 12 may include a bottom 22 which supports the mattress 14.

Figure 2:
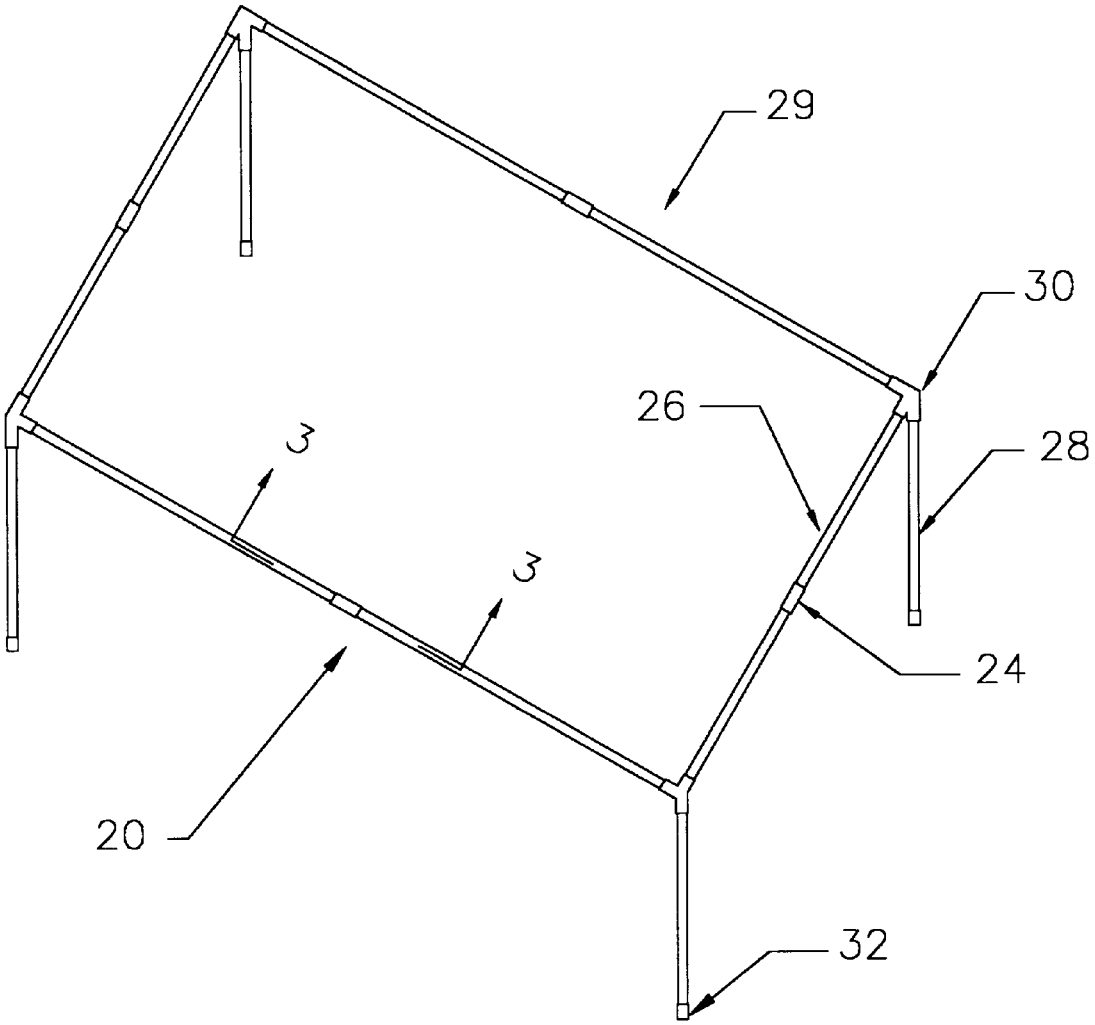
FIG. 2 is a perspective view of the frame utilized in the embodiment shown in FIG. 1.

When it is desired to store the bed 10, one end of each link 26 is detached from a coupling 24 or 30, allowing the frame 20 to transition from the rigid shape shown in FIG. 2 to the foldable configuration shown in FIG. 4. While still contained within the cover 12, the frame may be folded in with the rest of the cover 12 as shown in FIG. 7. The cover may then be situated atop the mattress 14, in the configuration shown in FIG. 5 and tied in a bundle using the catches 46 and 48, as illustrated in FIG. 7.

When ready for use, the steps described above may be reversed, so that the bed may be quickly assembled. Namely, by inserting an end of each link back into a coupling 24 or 30, aided by the internal cord 38, the frame 20 may be quickly and easily reassembled.

While the present invention has been described with respect to a limited number of embodiments, those skilled in the art will appreciate numerous modifications and variations therefrom. It is intended that the appended claims cover all such modifications and variations as fall within the true spirit and scope of the present invention.

What is claimed is:

1. A collapsible baby bed comprising:

a collapsible frame including at least two resiliently coupled relatively rigid links, said links coupled by a relatively resilient connector such that said links may be selectively relatively rigidly coupled to one another and selectively relatively resiliently coupled to one another through said resilient connector when the relatively rigid coupling between said links is released, said frame defining a open-topped sleeping surface with surrounding walls when said links are relatively rigidly coupled; and a fabric cover adapted to cover said frame.

2. The bed of claim 1 wherein said cover has a box shape, said bed further including a removable mattress positionable within said box shaped cover.

3. The bed of claim 2 wherein said mattress includes opposed ends and catches on said opposed ends so that the opposed ends may be connected together to form a bundle for storing said bed.

4. The bed of claim 1 wherein said frame is contained within said cover.

5. The bed of claim 4 wherein said frame is securable within said cover, said cover including a plurality of flaps formed in said cover.

6. The bed of claim 5 including a connection between each of said flaps and the rest of said cover.

7. The bed of claim 1 wherein said frame includes a rectangular portion and a plurality of legs extending from said rectangular portion.

8. The bed of claim 7 wherein said rectangular portion connects to said legs through triangularly shaped couplings having a set of three openings to telescopically receive said legs and said links form a part of said rectangular portion.

9. The bed of claim 1 when said collapsible frame includes a plurality of resiliently coupled links arranged to form a rectangular frame with extending legs, said links adapted to be separated from one another so as to allow said frame to be foldable into a reduced size.

* * * * *